US008662629B2

(12) United States Patent
Yamamoto

(10) Patent No.: US 8,662,629 B2
(45) Date of Patent: Mar. 4, 2014

(54) LIQUID EJECTION APPARATUS

(75) Inventor: Shinya Yamamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 329 days.

(21) Appl. No.: 13/284,664

(22) Filed: Oct. 28, 2011

(65) Prior Publication Data

US 2012/0105524 A1 May 3, 2012

(30) Foreign Application Priority Data

Oct. 29, 2010 (JP) ..... 2010-243610

(51) Int. Cl.
*B41J 2/165* (2006.01)

(52) U.S. Cl.
USPC ..... 347/23; 347/109; 347/22

(58) Field of Classification Search
USPC ..... 347/109, 22, 23
See application file for complete search history.

(56) References Cited

U.S. PATENT DOCUMENTS

| | | | |
|---|---|---|---|
| 6,419,411 | B1 | 7/2002 | Tanno |
| 2005/0062793 | A1 | 3/2005 | Takagi et al. |
| 2008/0123126 | A1 | 5/2008 | Harris |

FOREIGN PATENT DOCUMENTS

| | | | |
|---|---|---|---|
| EP | 0598701 | A2 | 5/1994 |
| JP | S58-116182 | A | 7/1983 |
| JP | S60-172575 | A | 9/1985 |
| JP | 563-254044 | A | 10/1988 |
| JP | H05-131720 | A | 5/1993 |
| JP | 2000-095374 | A | 4/2000 |
| JP | 2005-088209 | A | 4/2005 |
| JP | 2005-096187 | A | 4/2005 |
| WO | 01/89836 | A1 | 11/2001 |

OTHER PUBLICATIONS

European Patent Office, extended European Search Report for European Patent Application No. 11187031.7 (counterpart to above-captioned patent application), dated Feb. 7, 2012.

*Primary Examiner* — Julian Huffman
(74) *Attorney, Agent, or Firm* — Baker Botts L.L.P.

(57) ABSTRACT

A liquid ejection apparatus including: a first casing; a second casing; and a controller, wherein the first casing is movable between a close position close to the second casing and a distant position farther from the second casing than the close position, the first casing accommodating a head having an ejection face. The second casing accommodates: a support portion having a support face for supporting a recording medium while facing the ejection face; and a moving device configured to move the support portion, such that the support face selectively takes a first state to face the ejection face and a second state not to face the ejection face. A restraining portion restrains movement of the first casing located at the close position, and the controller controls the moving device, such that the support face takes the second state when the controller has received a restraint releasing signal.

14 Claims, 10 Drawing Sheets

LIQUID EJECTION APPARATUS

CROSS REFERENCE TO RELATED APPLICATION

The present application claims priority from Japanese Patent Application No. 2010-243610, which was filed on Oct. 29, 2010, the disclosure of which is herein incorporated by reference in its entirety.

BACKGROUND OF THE INVENTION

1. Field of the Invention

The present invention relates to a liquid ejection apparatus configured to eject liquid such as ink.

2. Description of the Related Art

In some cases, a user manually conducts a jamming resolving operation (e.g., an operation for clearing a jam of a recording medium in a conveyance path) in a liquid ejection apparatus. In order to define a work space for this, there is known a technique that a casing of a liquid ejection apparatus is constituted by a first casing accommodating a liquid ejection head and a second casing accommodating, e.g., a support portion for supporting a recording medium, and the first casing is movable with respect to the second casing. In this technique, when the first casing (an upper unit) is moved to a distant position distant from the second casing (a lower unit), a conveyance path defined by the first casing and the second casing is opened, making it possible to form a work space over the conveyance path.

SUMMARY OF THE INVENTION

However, in the above-described technique, when the first casing is located at the distant position, a support face of the support portion (a platen) is exposed to a space between the first and second casings, so that foreign matters may be landed on the support face. If the foreign matters are attached to the support face, the recording medium may be soiled, and a conveyance failure may occur by the foreign matters having entered into the apparatus.

This invention has been developed in view of the above-described situations, and it is an object of the present invention to provide a liquid ejection apparatus capable of preventing foreign matters from being attached to a support face when a first casing is located at a distant position.

The object indicated above may be achieved according to the present invention which provides a liquid ejection apparatus comprising: a first casing; a second casing; a restraining portion; and a controller, wherein the first casing is movable relative to the second casing between (i) a close position at which the first casing is close to the second casing and (ii) a distant position farther from the second casing than the close position, the first casing accommodating a liquid ejection head comprising an ejection face having a plurality of ejection openings through which liquid is ejected onto a recording medium, wherein the second casing accommodates: a support portion having a support face for supporting the recording medium while facing the ejection face; and a moving device configured to move the support portion such that the support face selectively takes (i) a first state in which the support face faces the ejection face and (ii) a second state in which the support face does not face the ejection face, wherein the restraining portion is configured to restrain the movement of the first casing located at the close position, and wherein the controller is configured to control the moving device such that the support face takes the second state when the controller has received a restraint releasing signal that indicates that the restraint of the restraining portion is released.

The object indicated above may be achieved according to the present invention which provides a liquid ejection apparatus comprising: a first casing; a second casing; and a controller, wherein the first casing is movable relative to the second casing between (i) a close position at which the first casing is close to the second casing and (ii) a distant position farther from the second casing than the close position, the first casing accommodating a liquid ejection head comprising an ejection face having a plurality of ejection openings through which liquid is ejected onto a recording medium, wherein the second casing accommodates: a support portion comprising a support face for supporting the recording medium while facing the ejection face; and a moving device configured to move the support portion such that the support face selectively takes (i) a first state in which the support face faces the ejection face and (ii) a second state in which the support face does not face the ejection face, wherein the liquid ejection apparatus further comprises a jamming detection section configured to detect an occurrence of a jamming of the recording medium, and wherein the controller is configured to control the moving device such that the support face takes the second state where the jamming detection section has detected the occurrence of the jamming.

The object indicated above may be achieved according to the present invention which provides a liquid ejection apparatus comprising: a first casing; a second casing; and a controller, wherein the first casing is movable relative to the second casing between (i) a close position at which the first casing is close to the second casing and (ii) a distant position farther from the second casing than the close position, the first casing accommodating a liquid ejection head comprising an ejection face having a plurality of ejection openings through which liquid is ejected onto a recording medium, wherein the second casing accommodates: a support portion comprising a support face for supporting the recording medium while facing the ejection face; and a moving device configured to move the support portion such that the support face selectively takes (i) a first state in which the support face faces the ejection face and (ii) a second state in which the support face does not face the ejection face, wherein the liquid ejection apparatus further comprises a first-casing-position detecting section configured to detect whether the first casing is located at the close position or the distant position, and wherein the controller is configured to control the moving device such that the support face takes the second state when the first-casing-position detecting section detects that the first casing is located at the distant position.

BRIEF DESCRIPTION OF THE DRAWINGS

The objects, features, advantages, and technical and industrial significance of the present invention will be better understood by reading the following detailed description of embodiments of the invention, when considered in connection with the accompanying drawings, in which.

DETAILED DESCRIPTION OF THE EMBODIMENTS

Figure 1:
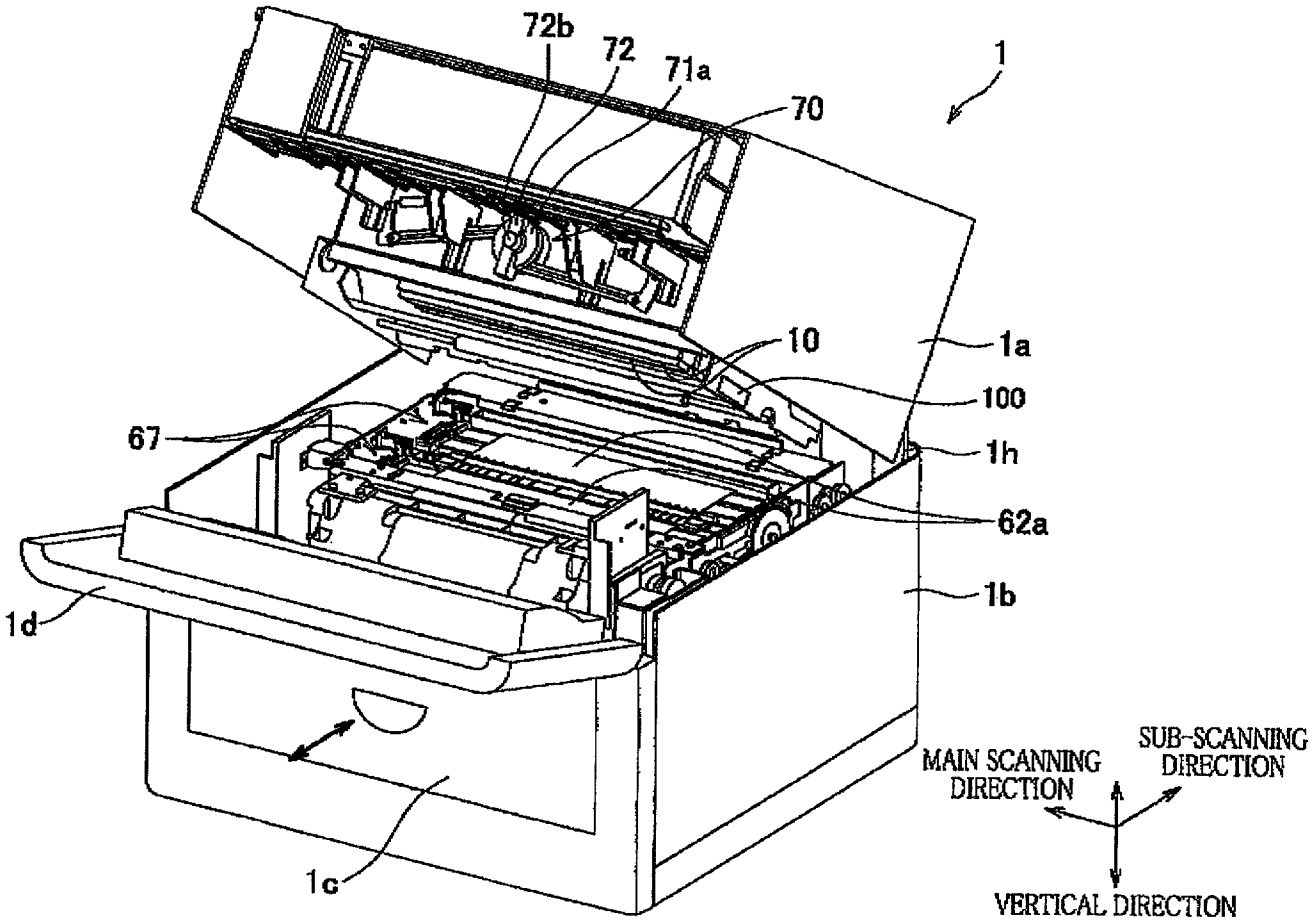
FIG. 1 is an external perspective view showing an ink-jet printer as a first embodiment of the present invention.

Hereinafter, there will be described embodiments of the present invention by reference to the drawings.

First, there will be explained an overall construction of an ink-jet printer 1 as a first embodiment of the present invention with reference to FIGS. 1 and 2.

The printer 1 includes a first casing 1*a* and a second casing 1*b* each having a rectangular parallelepiped shape and having generally the same size as each other. The first casing 1*a* opens in its lower face, and the second casing 1*b* opens in its upper face. As shown in FIG. 2, when the first casing 1*a* is superposed on the second casing 1*b* so as to seal the opening faces of the casings 1*a*, 1*b*, a space in the printer 1 is defined. A sheet-discharge portion 31 is provided on a top plate of the first casing 1*a*. In the space defined by the first and second casings 1*a*, 1*b* is formed a sheet conveyance path through which a recording medium in the form of a sheet P is conveyed from a sheet-supply unit to which will be described below toward the sheet-discharge portion 31 along bold arrows shown in FIG. 2.

The first casing 1*a* is movable and pivotable relative to the second casing 1*b* about an edge of a lower end thereof as a hinge portion 1*h*. Thus, the first casing 1*a* can be positioned at (a) a close position at which the first casing 1*a* is close to the second casing 1*b* (a position shown in FIG. 2) and (b) a distant position (for example, a position shown in FIG. 1) farther from the second casing 1*b* than the close position. It is noted that in the printer 1 is provided an open-close sensor 100 for sensing or detecting whether the first casing 1*a* is open or closed relative to the second casing 1*b*. A detection signal of the open-close sensor 100 is transmitted to a controller 1*p*. In the present embodiment, on the basis of the detection signal of the open-close sensor 100 transmitted to the controller 1*p*, a first-casing-position detecting section 101 of the controller 1*p* detects whether the first casing 1*a* is located at the close position or a position at which the first casing 1*a* is not close to the second casing 1*b* (noted that the position includes the distant position in FIG. 1). In addition to the closed position of the first casing 1*a* shown in FIG. 2 and a full-open position of the first casing 1*a* shown in FIG. 1, the open-close sensor 100 detects an open position of the first casing 1*a* when an inclination angle of the opened first casing 1*a* with respect to a horizontal plane is smaller than that of the first casing 1*a* located at the full-open position. Thus, also in the case when the first casing 1*a* is located at the open position that is different from the full-open position, the position detecting section 101 detects that the first casing 1*a* is located at the distant position distant from the second casing 1*b*. That is, the closed position of the first casing 1*a* is one example of the close position, and the open position and the full-open position of the first casing 1*a* except the closed position are examples of the distant position. It is noted that the open-close sensor 100 is constituted by a pair of components respectively provided on the first casing 1*a* and the second casing 1*b* at respective positions facing (or contacting) each other when the first casing 1*a* is located at the close position. When the first casing 1*a* is located at the distant position, the sheet conveyance path formed by the first casing 1*a* and the second casing 1*b* is exposed so as to form a work space for a user on an upper side of the sheet conveyance path. Springs are provided on the hinge portion 1*h* for urging the first casing 1*a* in a direction in which the first casing 1*a* is opened (i.e., in a direction from the close position toward the distant position). In the present embodiment, the first casing 1*a* can be opened up to about 35 degrees with respect to the horizontal plane.

A lock mechanism 70 as one example of a restraining or limiting portion is provided on a front face of the first casing 1*a* (a left front face thereof in FIG. 1). The lock mechanism 70 is for restraining or limiting (inhibiting) the movement of the first casing 1*a* located at the close position. A construction of the lock mechanism 70 will be explained later in more detail. A cover 1*d* is provided on a front face of the second casing 1*b*. The cover 1*d* is openable and closable so as to cover a front portion of the first casing 1*a*. When the cover 1*d* is opened, the lock mechanism 70 is exposed.

The first casing 1*a* accommodates: two heads 10 (namely, a precoat head 10 configured to eject pretreatment liquid and an ink-jet head 10 configured to eject black ink in order from an upstream side in a sheet conveyance direction indicated by bold arrows in FIG. 2); a controller 1*p* (see FIG. 2) configured to control operation of the components of the primer 1; and so on. It is noted that FIG. 2 omits illustrations of some components accommodated in the first casing 1*a*. Further, two cartridges and two sub-tanks respectively corresponding to the heads 10 are accommodated in the printer 1.

The second casing 1*b* accommodates: two support-maintenance units 60 respectively corresponding to the heads 10; the sheet-supply unit 1*c*; and so on.

Each of the cartridges stores a corresponding one of the pretreatment liquid and the black ink (hereinafter may be collectively referred to as "liquid") to be supplied to the corresponding head 10. The pretreatment liquid is liquid having a property of preventing spreading and see-through of the ink and a property of improving color production and quick drying of the ink, for example. The liquids in the respective cartridges are respectively supplied to the heads 10 via the sub-tanks by driving of pumps.

Figure 2:
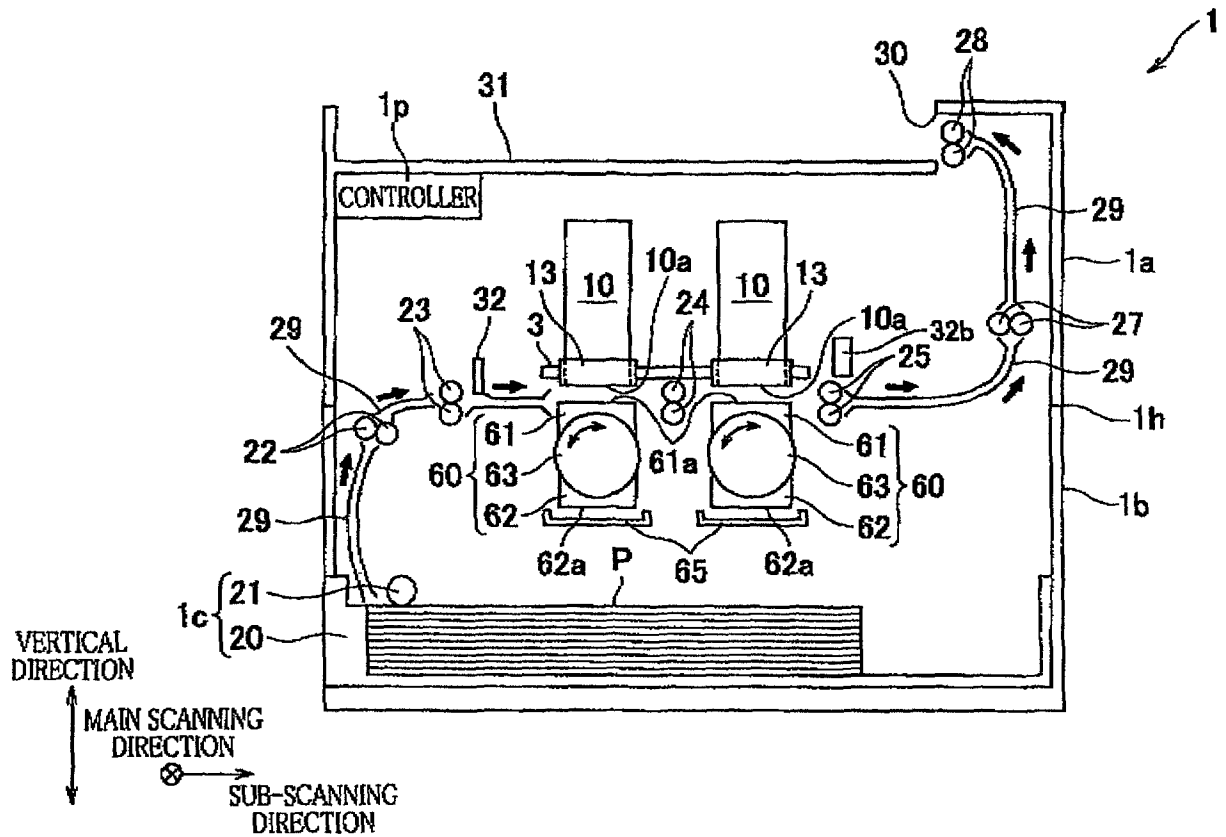
FIG. 2 is a side view generally showing an internal construction of the printer.

Each head 10 is a line head elongated in a main scanning direction shown in FIG. 2 and has a generally rectangular parallelepiped shape in its outer shape. The two heads 10 are distant from each other in a sub-scanning direction (perpendicular to the main scanning direction) shown in FIG. 2 and are supported by the first casing 1*a* via a frame 3 of the first casing 1*a*. For each head 10, a joint to which a flexible tube is to be connected is provided on an upper face of the head 10 (i.e., a face thereof facing upward in a vertical direction in FIG. 2). A lower face of the head 10 as an ejection face 10*a* has a multiplicity of ejection openings formed therein. The head 10 has channels formed therein through which the liquid supplied from the corresponding cartridge flows to the ejection openings via the tube and the joint. On the head 10 is provided an annular member 13 enclosing an outer portion of the ejection face 10*a*. A construction of the annular member 13 will be explained below in more detail.

The controller 1*p* includes: a Central Processing Unit (CPU); a Read Only Memory (ROM), a Random Access Memory (RAM) including nonvolatile RAM; an Interface (I/F); and so on. The ROM stores therein programs to be executed by the CPU, various unchanged data; and so on. The RAM temporarily stores data (e.g., image data) required for the execution of the program. The controller 1*p* is configured to transmit and receive the data to and from an external device (e.g., a PC connected to the printer 1) via the I/F.

Figure 3:
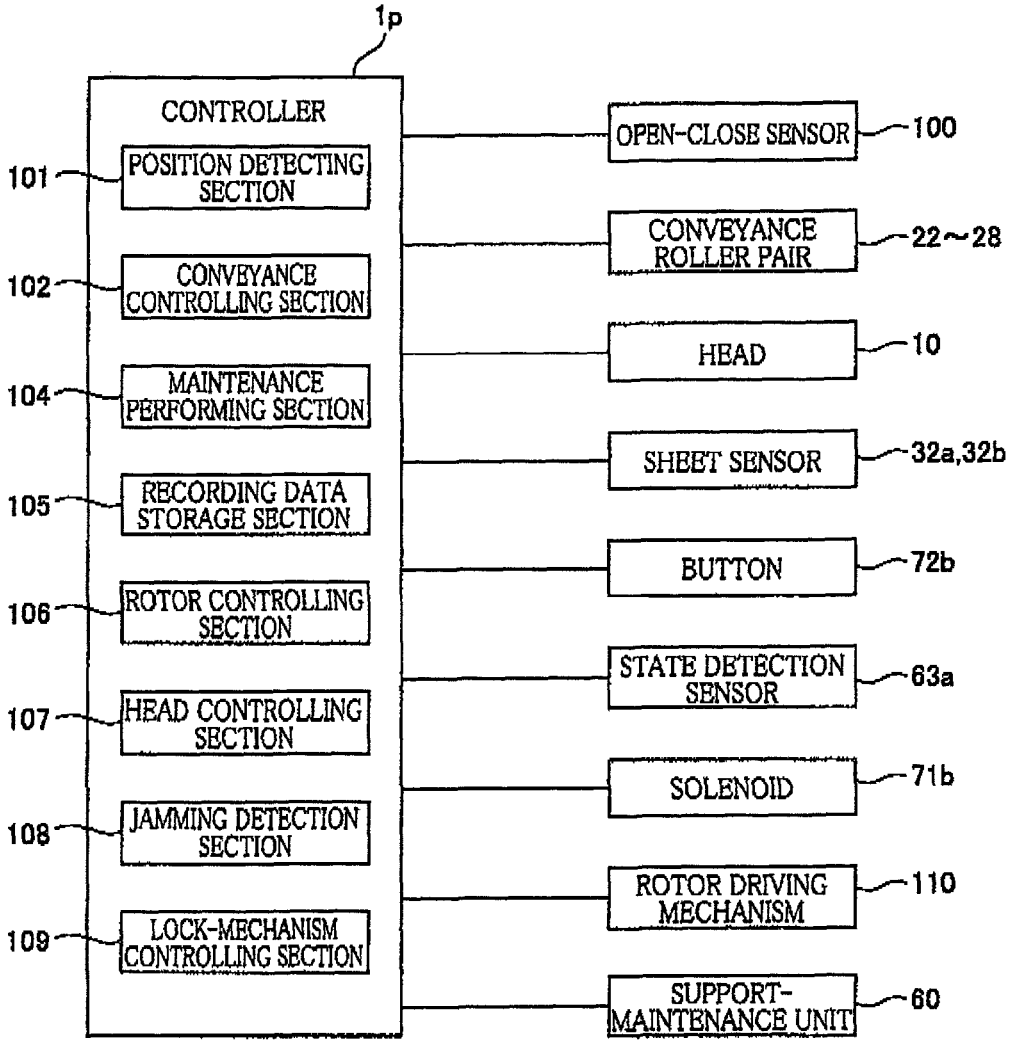
FIG. 3 is a block diagram showing a general configuration of the printer as the first embodiment of the present invention.

The sheet-supply unit 1*c* includes a sheet-supply tray 20 and a sheet-supply roller 21. The sheet-supply tray 20 can be mounted on and removed from the second casing 1*b* in the sub-scanning direction. The sheet-supply tray 20 has a box-like shape opening upward and can accommodate various sizes of the sheets P. The sheet-supply roller 21 is rotated by control of a conveyance controlling section 102 (see FIG. 3) of the controller 1*p* to supply an uppermost one of the sheets P in the sheet-supply tray 20. The sheet P supplied by the sheet-supply roller 21 is conveyed to the support-maintenance units 60 by roller pairs 22, 23 while being guided by guides 29.

Each of the support-maintenance units 60 is disposed so as to face a corresponding one of the ejection faces 10*a* of the heads 10 in the vertical direction. The support-maintenance unit 60 includes: a rotor 63 (as a part of a support portion) having a shaft extending in the main scanning direction and rotatable about the shaft by control of a maintenance performing section 104 of the controller 1*p*; a platen 61 (as one example of the support portion) and a facing member 62 (as one example of a maintenance portion) fixed to an outer circumferential face of the rotor 63; a waste-ink tray 65; and a wiper 67 as one example of a cleaning member (see FIG. 1). Near the rotor 63, a state detection sensor 63*a* is fixed to a frame, not shown, supported by the second casing 1*b*. The state detection sensor 63*a* is for detecting a rotational position of the rotor 63 for supporting the platen 61 relative to the second casing 1*b* to detect whether a support face 61*a* is in a first state or a second state which will be described below.

Bach of the platen 61 and the facing member 62 is one size larger than the ejection face 10*a* in the main scanning direction and the sub-scanning direction, and the platen 61 and the facing member 62 are disposed so as to be opposed to each other in the vertical direction.

A face of the platen 61 is the support face 61*a* for supporting the sheet P while facing the ejection face 10*a*. A material and a processing for the support face 61*a* are employed so as to reliably hold the sheet P. For example, a silicon layer having a low viscosity is formed on the support face 61*a*, and a multiplicity of ribs are formed on the support face 61*a* in the sub-scanning direction, preventing floating and the like of the sheet P placed on the support face 61*a*. The platen 61 is formed of a resin material.

The facing member 62 is formed of a material such as a glass or a metal (e.g., SUS) having a property of not or hardly sucking water. A face of the facing member 62 is a smooth facing face 62*a* that can face the ejection face 10*a*.

The rotation of the rotor 63 changes a state of the rotor 63 between (a) the first state (see FIG. 2) in which the support face 61*a* faces the ejection face 10*a*, and the facing face 62*a* does not face the ejection face 10*a* (the facing face 62*a* faces downward) and (b) the second state (see FIG. 1) in which the support face 61*a* does not face the ejection face 10*a* (the support face 61*a* faces downward), and the facing face 62*a* faces the ejection face 10*a*. In the present embodiment, the controller 1*p* is configured to control the rotor 63 such that the first state is established in a recording mode in which the liquid is ejected from the ejection openings onto the sheet P and in a recording waiting mode in which the printer 1 is waiting for a recording command and such that the second state is established in a maintenance mode in which a maintenance is performed for the ejection face 10*a*.

In the present embodiment, the printer 1 is in the maintenance mode until the controller 1*p* receives a first recording command from the external device after the printer 1 has been turned on. The printer 1 is in the recording mode until image recording based on the recording command is finished after the controller 1*p* has received the recording command from the external device. The printer 1 is in the recording waiting mode until a predetermined period passes (in a case where the controller 1*p* receives a new recording command in the predetermined period, until the controller 1*p* receives the new recording command) after the image recording based on the recording command is finished. It is noted that the predetermined period is a length of time in which, even where the ejection face 10*a* is exposed, there is no effect of drying on the ejection face 10*a*. Where the predetermined period has passed without receipt of a new recording command after the image recording based on the recording command is finished, the printer 1 is in the maintenance mode until the controller 1*p* receives a new recording command after the predetermined period.

In the maintenance mode, the maintenance performing section 104 of the controller 1*p* is configured to selectively perform maintenance operations such as a capping (an operation for covering the ejection face 10*a* with the facing face 62*a* and the annular member 13, see FIG. 4), a purging (an operation for forcibly ejecting the liquid from the ejection openings by applying a pressure to the channels in the head 10 by the pump, for example), a flushing (an operation for forcibly ejecting the liquid from the ejection openings by driving actuators of the head 10 on the basis of flushing data that is different from image data stored in a recording data storage section 105 of the controller 1*p*), and so on. For example, the purging and the flushing (hereinafter may be collectively referred to as "forcefully ejecting operation") are performed where the liquid is not ejected from the ejection openings for equal to or longer than a specific period (here, a specific period for the flushing may be longer than a specific period for the purging). The capping is performed in a period in which the purging and the flushing are not performed. The purging and the flushing discharge air bubbles and dust particles having entered in the ejection openings, together with the liquid. The capping prevents drying of peripheries of the ejection openings. Thus, these maintenance operations can recover the ejection characteristics or prevent the ejection characteristics from deteriorating.

In the maintenance mode, before the above-described maintenance operations, the maintenance performing section 104 (see FIG. 3) of the controller 1*p* initially judges whether the support face 1*a* is in the second state or not by referring to an output of the state detection sensor 63*a*. The state detection sensor 63*a* is for detecting whether the support face 1*a* is in the first state or the second state. Where the support face 1*a* is not in the second state (that is, the support face 1*a* is in the first state), a rotor controlling section 106 of the controller 1*p* drives a rotor driving mechanism 110 for rotating the rotor 63, to rotate the rotor 63 180 degrees, thereby changing the support face 1*a* from the first state to the second state, and then the maintenance performing section 104 performs the maintenance operations. Where the support face 1*a* is in the second state, the rotor controlling section 106 of the controller 1*p* does not rotate the rotor 63 (that is, the second state is maintained), and the maintenance performing section 104 performs the maintenance operation. Thus, in the forcefully ejecting operation, the liquid is ejected from the ejection openings onto the facing face 62*a*.

In the recording mode, before the control of the components of the printer 1 for the image recording the control for the liquid ejection and the sheet conveyance), the maintenance performing section 104 of the controller 1*p* initially judges whether the support face 1*a* is in the first state or not by referring to the output of the state detection sensor 63*a*. Where the support face 1*a* is not in the first state (that is, the support face 1*a* is in the second state), the rotor controlling section 106 of the controller 1*p* drives the rotor driving mechanism 110 to rotate the rotor 63 180 degrees, thereby changing the support face 1*a* from the second state to the first state, and then the control for the image recording is performed. Where the support face 1*a* is in the first state, the controller 1*p* does not rotate the rotor 63 (that is, the first state is maintained), and the control for the image recording is performed.

In the recording waiting mode, the controller 1*p* only checks a presence or absence of the receipt of the recording command and does not execute any other controls. In this mode, the first state set in the recording mode is maintained, and the components of the printer 1 are stopped.

The waste-ink tray 65 is disposed on a lower side of the rotor 63 and so on and communicates with a waste-liquid tank, not shown. The liquid dropped down in the forcefully ejecting operation and cleaning which will be described below is received by the waste-ink tray 65 and discharged to the waste-liquid tank.

The wiper 67 is movable in the main scanning direction by the control of the maintenance performing section 104 from a waiting position (see FIG. 1) that is located at a rear side of the rotor 63 and so on in a sheet of FIG. 2. The wiper 67 is a plate-like member formed of an elastic material such as a rubber and extending in the sub-scanning direction. The wiper 67 is moved in the main scanning direction while being deformed by contacting the facing face 62*a* in a state in which a distal end of the wiper 67 faces downward, thereby removing the liquid attached to the facing face 62*a* (that is, the cleaning of the facing face 62*a* is performed).

In the recording mode, the head 10 is supported by the frame 3 such that the ejection face 10*a* faces the support face 61*a* so as to form a clearance suitable for the recording between the ejection face 10*a* and the support face 61*a*. The sheet P conveyed from the sheet-supply unit 1*c* to the support-maintenance units 60 as described above is conveyed by the roller pair 23 and roller pairs 24, 25 while being supported by the support faces 61*a*. When the sheet P passes through positions just under the respective two heads 10 in order, a head controlling section 107 (see FIG. 3) of the controller 1*p* drives the heads 10 to eject the liquid from the ejection openings of the respective ejection faces 10*a* onto the sheet P, so that the image is formed on the sheet P. The liquid ejecting operation from the ejection openings is performed under the control of the head controlling section 107 on the basis of a detection signal transmitted from a sheet sensor 32*a*. The sheet P is then conveyed upward by conveyance roller pairs 27, 28 while being guided by guides 29 and discharged onto the sheet-discharge portion 31 through an opening 30 formed in an upper portion of the first casing 1*a*. It is noted that, near the conveyance rollers 25, a sheet sensor 32*b* is fixed to the frame 3 supported by the first casing 1*a*. The detection signals of the sheet sensors 32*a*, 32*b* are transmitted to the controller 1*p*, which enables a jamming detection section 108 of the controller 1*p* to detect a jamming (i.e., a jamming of the sheet P in the sheet conveyance path). For example, when the sheet sensor 32*b* does not detect the sheet P within a specific period of time from the detection of the sheet P by the sheet sensor 32*a*, the jamming detection section 108 detects the jamming. Instead, the jamming detection section 108 may detect the jamming on the basis of signals outputted by the sheet sensors 32*a*, 32*b* and signals outputted by drive motors of the roller pairs 22-28.

Figure 4A:
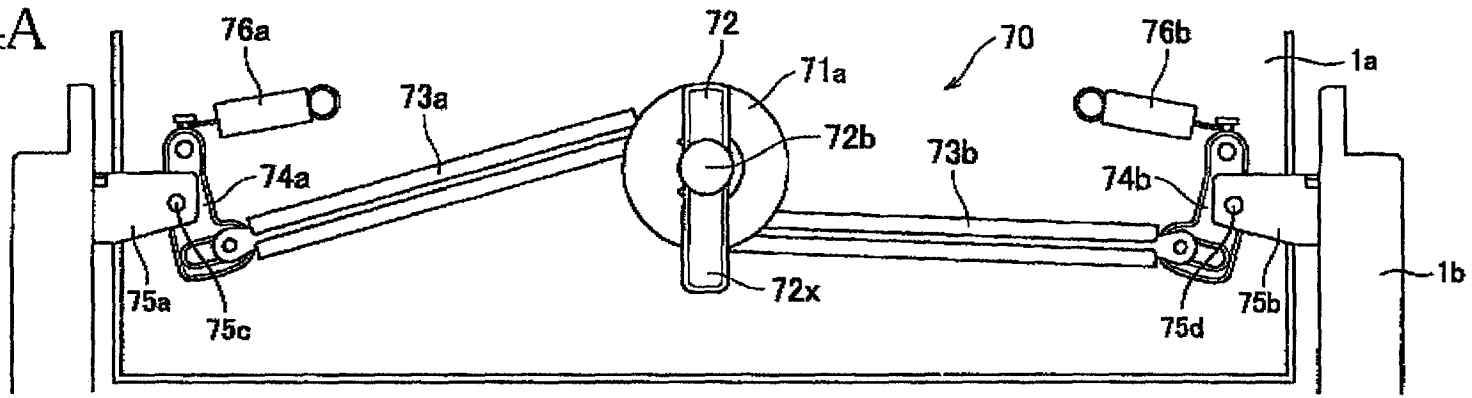
FIGS. 4A and 4B are front devotional views showing a lock mechanism.
Figure 4B:
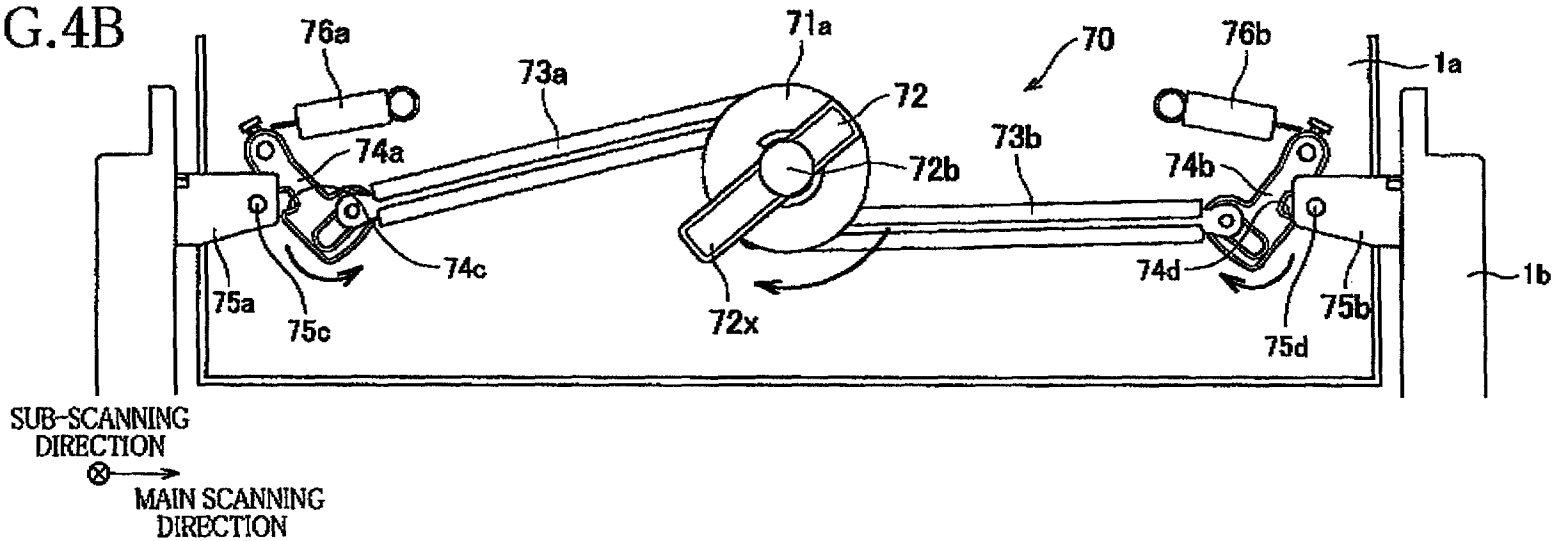

There will be next explained the construction of the lock mechanism 70 with reference to FIGS. 4A and 4B.

The lock mechanism 70 includes: a rotational member 71*a*; two interlocked members 73; 73*b*; pivot members 74; 74*b*; fixed members 75; 75*b*; and springs 76; 76*b*. The rotational member 71*a* has a circular cylindrical shape. The two interlocked members 73; 73*b* are connected, at their respective one ends in their longitudinal direction, to the outer circumferential face of the rotational member 71*a*. The pivot members 74; 74*b* are respectively connected to the other ends of the respective interlocked members 73; 73*b* in the longitudinal direction. The springs 76; 76*b* are respectively connected to upper ends of the respective pivot members 74; 74*b*. Recessed portions 74*c*, 74*d* are formed in the respective pivot members 74; 74*b* so as to be open in a direction away from the rotational member 71*a*. Engaging portions 75*c*, 75*d* are respectively provided on the fixed members 75; 75*b* so as to be insertable into the respective recessed portions 74*c*, 74*d*. It is noted that pivotal shafts of the respective pivot members 74*a*, 74*b* are fixed to the first casing 1*a*, and the springs 76*a*, 76*b* are fixed to the first casing 1*a* at one ends of the respective springs 76*a*, 76*b* in a direction directed toward the rotational member 71*a*. Further, the fixed members 75*a*, 75*b* are fixed to the second casing 1*b*.

A handle or lever 72 having a rod-like shape is fixed to a front side of the rotational member 71*a*. The handle 72 can be manually rotated by the user and is rotated together with the rotational member 71*a*. A button 72*b* that can be pressed by the user is provided at a rotational center of the handle 72. Further, as shown in FIG. 5, a solenoid 71*b* for inhibiting the rotation of the handle 72 is fixed to the frame, not shown, supported by the first casing 1*a*.

The springs 76*a*, 76*b* respectively urge the upper ends of the respective pivot members 74*a*, 74*b* in the direction directed toward the rotational member 71*a*. As a result, as shown in FIG. 4A, in a situation in which an external force is not applied, the portions of the lock mechanism 70 are at rest in a state in which the handle 72 extends in the vertical direction.

Figure 5A:
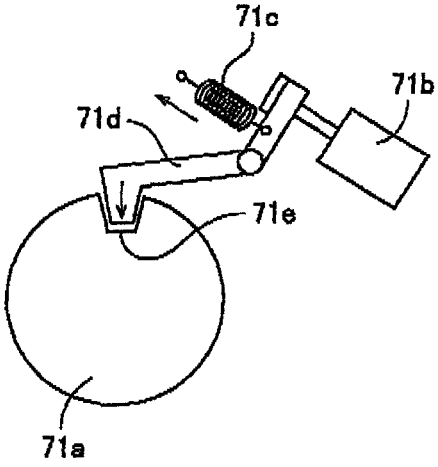
FIGS. 5A and 5B are schematic views respectively for explaining a restrained state and an unrestrained state of a rotational member in the present embodiment.
Figure 5B:
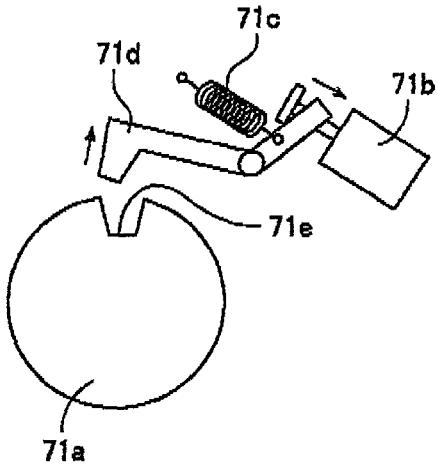

As shown in FIG. 5A, the solenoid 71*b* is normally in its "OFF" state, whereby a rotation restraining member 71*d* for restraining or limiting the rotation of the handle 72 is inserted in a recessed portion 71*e* of the rotational member 71*a* by an elastic force of a spring 71*c*. Thus, the handle 72 is normally is a rotation inhibited state in which the rotation of the handle 72 is inhibited. Further, as shown in FIG. 5B, when the solenoid 71*h* is driven by a lock-mechanism controlling section 109 of the controller 1*p*, the solenoid 71*b* is changed to an "ON" state, so that a force greater than the elastic force of the spring 7*k* is applied to the rotation restraining member 71*d* by the solenoid 71*b*. Thus, the rotation restraining member 71*d* is disengaged from the recessed portion 71*e* of the rotational member 71*a*, whereby the handle 72 is changed from the rotation inhibited state to a rotation allowed state. For example, when the user has pressed down the button 72*b* in order to perform a jamming resolving operation (that is an operation for clearing the jamming of the sheet P in the sheet conveyance path) and so on, a restraint releasing signal for releasing the restraint (lock) of the lock mechanism 70 is transmitted from a sensor provided in the button 72*b* to the controller 1*p*. Further, where the jamming in the sheet conveyance path has been detected by the jamming detection section 108 without the user pressing down the button 72*b*, the controller 1*p* executes the same processing as in the case where the restraint releasing signal is transmitted to the controller 1*p* as will be described below. When the controller 1*p* has received the restraint releasing signal, as will be explained in detail with reference to FIG. 7, the controller 1*p* executes processings (S2-S9) according to a situation and then the lock-mechanism controlling section 109 drives the solenoid 71*b* to change the handle 72 from the rotation inhibited state to the rotation allowed state (S10).

When the engaging portions 75*c*, 75*d* are respectively inserted into the recessed portions 74*c*, 74*d* of the respective pivot members 74*a*, 74*b* in the state shown in FIG. 4A, the engaging portions 75*c*, 75*d* are respectively engaged with the recessed portions 74*c*, 744, whereby the pivot members 74*a*, 74*b* whose pivotal shafts are fixed to the first casing 1*a* are restrained or limited from moving relative to the respective fixed members 75*a*, 75*b*. As a result, the (pivotal) movement of the first casing 1*a* positioned at the close position relative to the second casing 1*b* is restrained or inhibited.

When the handle 72 in the rotation allowed state has been rotated in a clockwise direction by the user against the urging forces of the springs 76*a*, 76*b*, as shown in FIG. 4B, the pivot members 74*a*, 74*b* are pivoted in the direction in which the pivot members 74*a*, 74*b* are moved toward the rotational member 71*a*. As a result, the engagements of the recessed portions 74*c*, 74*d* of the respective pivot members 74*a*, 74*b* and the engaging portions 75*c*, 75*d* of the respective fixed members 75*a*, 75*b* are released, whereby the restraint of the movement of the first casing 1*a* positioned at the close position relative to the second casing 1*b* is released. This enables the user to manually move the first casing 1*a* from the close position to the distant position.

Figure 6:
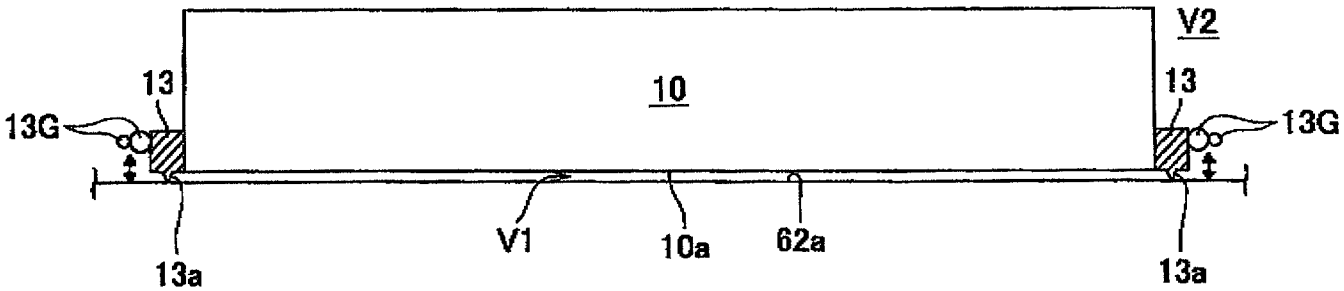
FIG. 6 is a schematic view showing a head and an annular member.

There will be next explained the construction of the annular member 13 with reference to FIG. 6.

The annular member 13 is formed of an elastic material such as a rubber and has an annular shape enclosing the outer circumferential portion of the ejection face 10*a* in plan view. A lower end of the annular member 13 has a projecting portion 13*a* having an inverted triangle shape in cross section.

The annular member 13 is movable upward and downward by gears 13G. Thus, the annular member 13 can be positioned at (i) an upper position at which the projecting portion 13*a* is located above the ejection face 10*a* and (ii) a lower position at which the projecting portion 13*a* is located below the ejection face 10*a*. The controller 1*p* controls a motor for rotating the gears 13G, such that the annular member 13 is positioned at the lower position (see FIG. 6) during the capping and such that the annular member 13 is positioned at the upper position in the other operations.

During the capping, as shown in FIG. 6, a distal end of the projecting portion 13*a* is held in contact with the facing face 62*a*, whereby an ejection space V1 formed between the ejection face 10*a* and the facing face 62*a* is isolated from an outside space V2.

Figure 7:
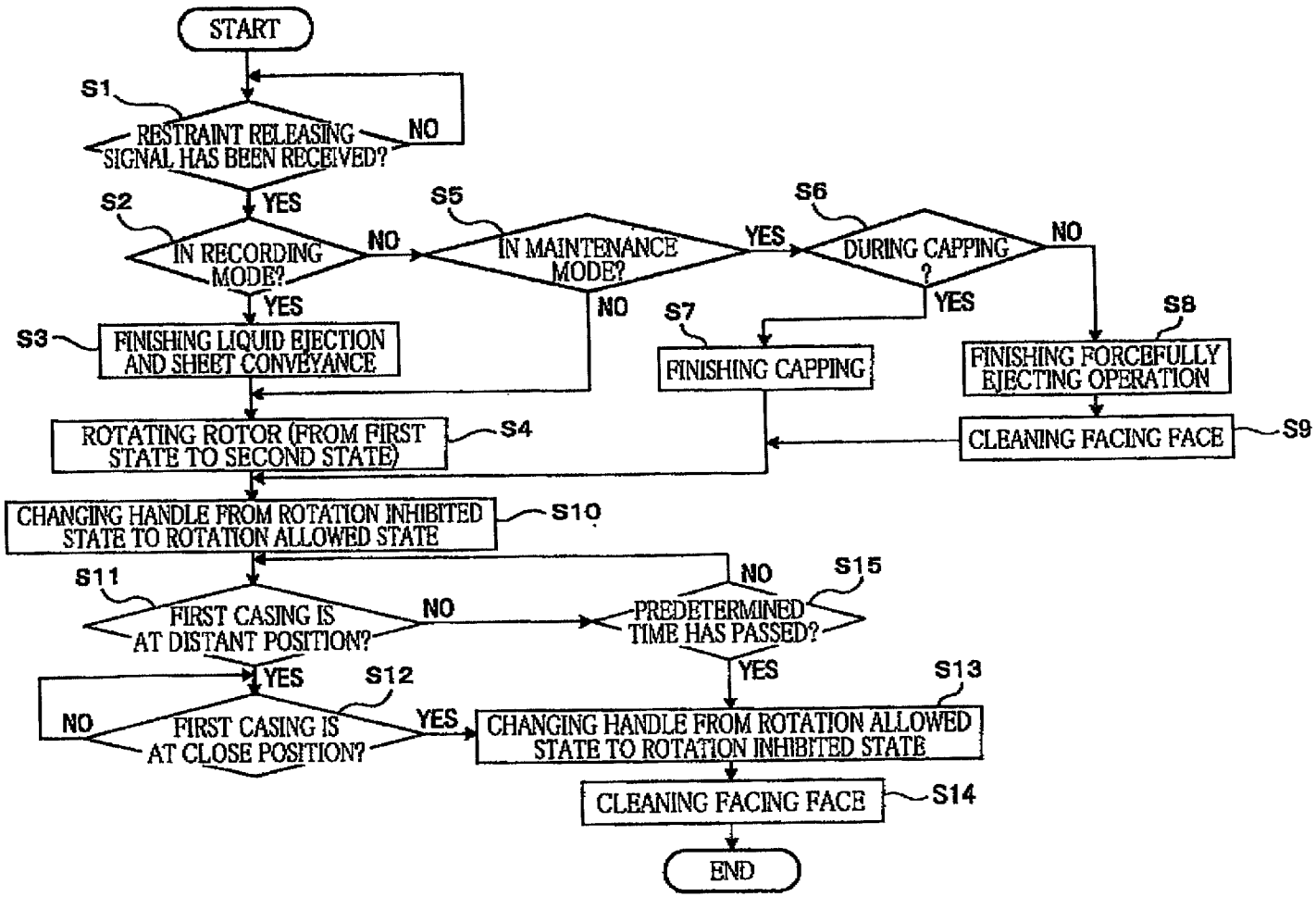
FIG. 7 is a flow-chart showing a control executed by a controller of the printer in response to receipt of a restraint releasing signal.

There will be next explained the processings executed by the controller 1*p* in response to the receipt of the restraint releasing signal with reference to FIG. 7. It is noted that a routine shown in FIG. 7 is executed every predetermined period (once every 5 ms, for example) from a timing when the printer 1 is turned on to a timing when the printer 1 is turned off.

Where the controller 1*p* has received the restraint releasing signal (S1: YES), the controller 1*p* judges in S2 whether the printer 1 is in the recording mode or not. Where the printer 1 is in the recording mode (S2: YES), the controller 1*p* in S3 stops the driving of the actuators of the heads 10 and the drivings of the sheet-supply roller 21 and the conveyance roller pairs 22-28 to finish the liquid ejection and the sheet conveyance. When in S4, the controller 1*p* drives a rotation mechanism for rotating the rotor 63, to rotate the rotor 63 180 degrees, thereby changing the support face 1*a* from the first state to the second state. Then in S10, the controller 1*p* drives the solenoid 71*b* to change the handle 72 from the rotation inhibited state to the rotation allowed state.

Where the printer 1 is not in the recording mode (S2: NO), the controller 1*p* in S5 judges whether the printer 1 is in the maintenance mode or not.

Where the printer 1 is not in the maintenance mode, that is, where the printer 1 is in the recording waiting mode (S5: NO), the controller 1*p* executes the processing in S4 and goes to S10. Where the printer 1 is in the maintenance mode (S5: YES), the controller 1*p* judges in S6 whether the capping is being performed or not. Where the capping is being performed (S6: YES), the controller 1*p* in S7 drives the gears 130 to move the annular member 13 from the lower position to the upper position, thereby finishing or releasing the capping. The controller 1*p* then goes to S10.

Where the capping is not being performed, that is, where the forcefully ejecting operation is being performed (S6: NO), the controller 1*p* in S8 stops the driving for the forcefully ejecting operation (specifically, the controller 1*p* stops the driving of the pump in the case of the purging and the driving of the actuators in the case of the flushing) to finish the forcefully ejecting operation. Then in S9, the controller 1*p* drives a moving mechanism for moving the wiper 67, to perform the cleaning of the facing face 62*a* by the wiper 67. The controller 1*p* then goes to S10.

After the processing in S10, the controller 1*p* in S11 judges whether the first casing 1*a* has been moved to the distant position or not on the basis of the signal from the open-close sensor 100. Where the controller 1*p* has judged that the first casing 1*a* has been moved to the distant position (S11: YES), the controller 1*p* in S12 judges whether the first casing 1*a* has been returned to the close position from the distant position or not on the basis of the signal from the above-described open-close sensor 100. Until the first casing 1*a* is returned to the close position after moving to the distant position, the user can conduct operations (works) such as the jamming resolving operation in the work space formed between the casings 1*a*, 1*b*. The user returns the first casing 1*a* from the distant position to the close position after the operations.

Where the controller 1*p* has judged that the first casing 1*a* has been returned to the close position (S12: YES), the controller 1*p* in S13 drives the solenoid 71*b* to change the handle 72 from the rotation allowed state to the rotation inhibited state. Then in S14, the controller 1*p* drives the wiper 67 to clean the facing face 62*a* like in S9, and this routine is finished.

Where the first casing 1*a* has not been moved to the distant position (S11: NO), and a predetermined length of time has passed after the processing in S10 (S15: YES), the controller 1*p* goes to S13. In this case, after the processing in S13, this routine may be finished by omitting the processing in S14.

Where the printer 1 has changed to the maintenance mode after this routine is finished, the second state is maintained. Where the printer 1 has changed to the recording mode or the recording waiting mode after this routine is finished, the support face 1*a* is changed from the second state to the first state.

As thus explained, in the printer 1 as the present embodiment, where the controller 1*p* has received the restraint releasing signal (S1: YES), the controller 1*p* controls the rotor 63 such that the support face 1*a* is changed to the second state (S4). As a result, when the first casing 1*a* has been moved to the distant position, the support face 61*a* is not exposed to the space between the first and second casings 1*a*, 1*b*, making it possible to prevent the foreign matters from landing on or being attached to the support face 61*a*. It is noted that the printer 1 as the present embodiment includes the open-close sensor 100, but the open-close sensor 100 may be omitted from the printer 1.

The controller 1*p* controls the rotor 63 such that the support face 1*a* is changed to the first state in the recording mode and to the second state in the maintenance mode. Accordingly, where the restraint releasing signal has been received in the maintenance mode, the controller 1*p* only needs to control the rotor 63 such that the second state is maintained, thereby providing easy control.

After the first casing 1*a* has moved from the distant position to the close position (S12: YES), the controller 1*p* controls the support-maintenance unit 60 such that the wiper 67 cleans the facing face 62*a* (S14). As a result, even where the foreign matters are attached to the facing face 62*a* in the state in which the first casing 1*a* is positioned at the distant position, it is possible to remove the foreign matters attached to the facing face 62*a* by the wiper 67. Further, it is possible to prevent the foreign matters to fly into the casings 1*a*, 1*b* and to prevent a malfunction caused by the foreign matters in subsequent processings.

Where the controller 1*p* has received the restraint releasing signal in the recording mode (S2: YES), the controller 1*p* controls the heads 10, the sheet-supply roller 21, and the conveyance roller pairs 22-28 to finish the liquid ejection and the sheet conveyance (S3). When the first casing 1*a* is moved to the distant position during the liquid ejection and/or the sheet conveyance, the liquid ejected from the ejection openings may fly into the casings 1*a*, 1*b* and land on other components, and malfunctions of the components such as the conveyance roller pairs 22-28 may be caused. However, in the above-described construction of the present embodiment, it is possible to avoid these situations.

The controller 1*p* controls the heads 10 and so on in the maintenance mode so as to perform the forcefully ejecting operation for ejecting the liquid from the ejection openings onto the facing face 62*a*. That is, in this case, the facing face 62*a* functions as a liquid receiving member for receiving the liquid ejected in the forcefully ejecting operation. As a result, there is no need to provide another component as the liquid receiving member, thereby simplifying the construction of the printer 1.

Where the controller 1*p* has received the restraint releasing signal in the forcefully ejecting operation (S6: NO), the controller 1*p* controls the heads 10 and so on so as to finish the forcefully ejecting operation (S8) and then controls the support-maintenance units 60 so as to clean the facing face 62*a* by the wiper 67 (S9). If the user reaches into the space between the first and second casings 1*a*, 1*b* with his or her hand after the forcefully ejecting operation, the liquid having landed on the facing face 62*a* in the forcefully ejecting operation may be attached to the user's hand. However, in the above-described construction of the present embodiment, it is possible to avoid this situation.

As shown in FIG. 6, the annular member 13 is provided on the head 10. Since the ejection space V1 is isolated from the outside space V2 by the annular member 13 during the capping, a humidity in the ejection space V1 can be kept appropriate, thereby preventing the drying at the peripheries of the ejection openings. Further, since the facing face 62*a* is used for preventing the drying, there is no need to provide another component for contacting the annular member 13, thereby simplifying the construction of the printer 1.

Figure 8:
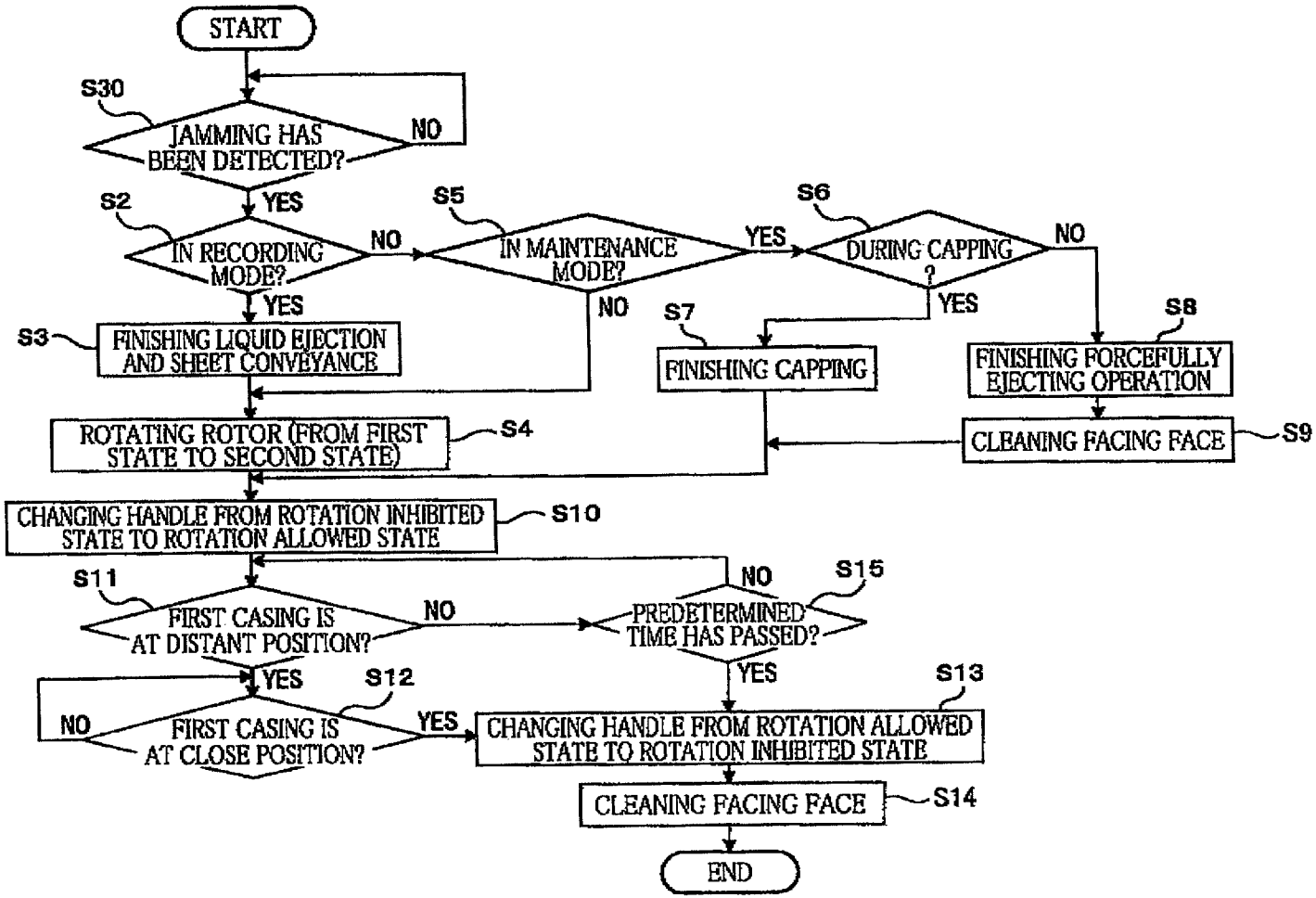
FIG. 8 is a flow-chart showing a control executed by the controller on the basis of a presence or absence of jamming.

It is noted that, as described above, when the controller 1*p* has detected the occurrence of the jamming, the controller 1*p* executes the same processings as in the case where the controller 1*p* has received the restraint releasing signal. There will be next explained these processings with reference to FIG. 8. Like the routine in FIG. 7, a routine shown in FIG. 8 is executed every predetermined period (once every 5 ms, for example) from the timing when the printer 1 is turned on to the timing when the printer 1 is turned off. In FIG. 8, the controller 1*p* in S30 judges whether the occurrence of the jamming is being detected or not. The jamming is being detected by the jamming detection section 108 on the basis of the detection signals of the sheet sensors 32*a*, 32*b*, for example. Where the occurrence of the jamming has been detected (S30: YES), the controller 1*p* goes to S2. On the other hand, where the occurrence of the jamming has not been detected (S30: NO), the controller 1*p* repeats the processing in S30. In the routine in FIG. 8, where the occurrence of the jamming has been detected, the printer 1 executes the same processings as in the case where the controller 1*p* has received the restraint releasing signal, without any need for the user to perform the operation for transmitting the restraint releasing signal (i.e., pressing the button 72*b*) in the occurrence of the jamming. Thus, it is possible for the user to smoothly perform the jamming resolving operation.

It is noted that, in the routine shown in FIG. 8, where the controller 1*p* has detected the occurrence of the jamming (S30), the controller 1*p* in S10 changes the handle 72 from the rotation inhibited state to the rotation allowed state, but, in view of the routines in FIGS. 7 and 8, when having received the restraint releasing signal or detected the occurrence of the jamming, the controller 1*p* performs the control for changing the handle 72 from the rotation inhibited state to the rotation allowed state. Thus, it is possible to consider that the controller 1*p* executes the control for restraining (limitating) and releasing the movement of the first casing 1*a* with respect to the second casing 1*a*, by detecting a relatively high possibility that the first casing 1*a* is moved to the distant position distant from the second casing 1*a* in the near future. In other words, it is possible to consider that the controller 1*p* of the present embodiment executes the control for restraining and releasing the movement of the first casing 1*a* with respect to the second casing 1*a*, on the basis of a signal or a detection result indicating that there is a relatively high possibility that the first casing 1*a* located at the close position is moved to the distant position.

Figure 9:
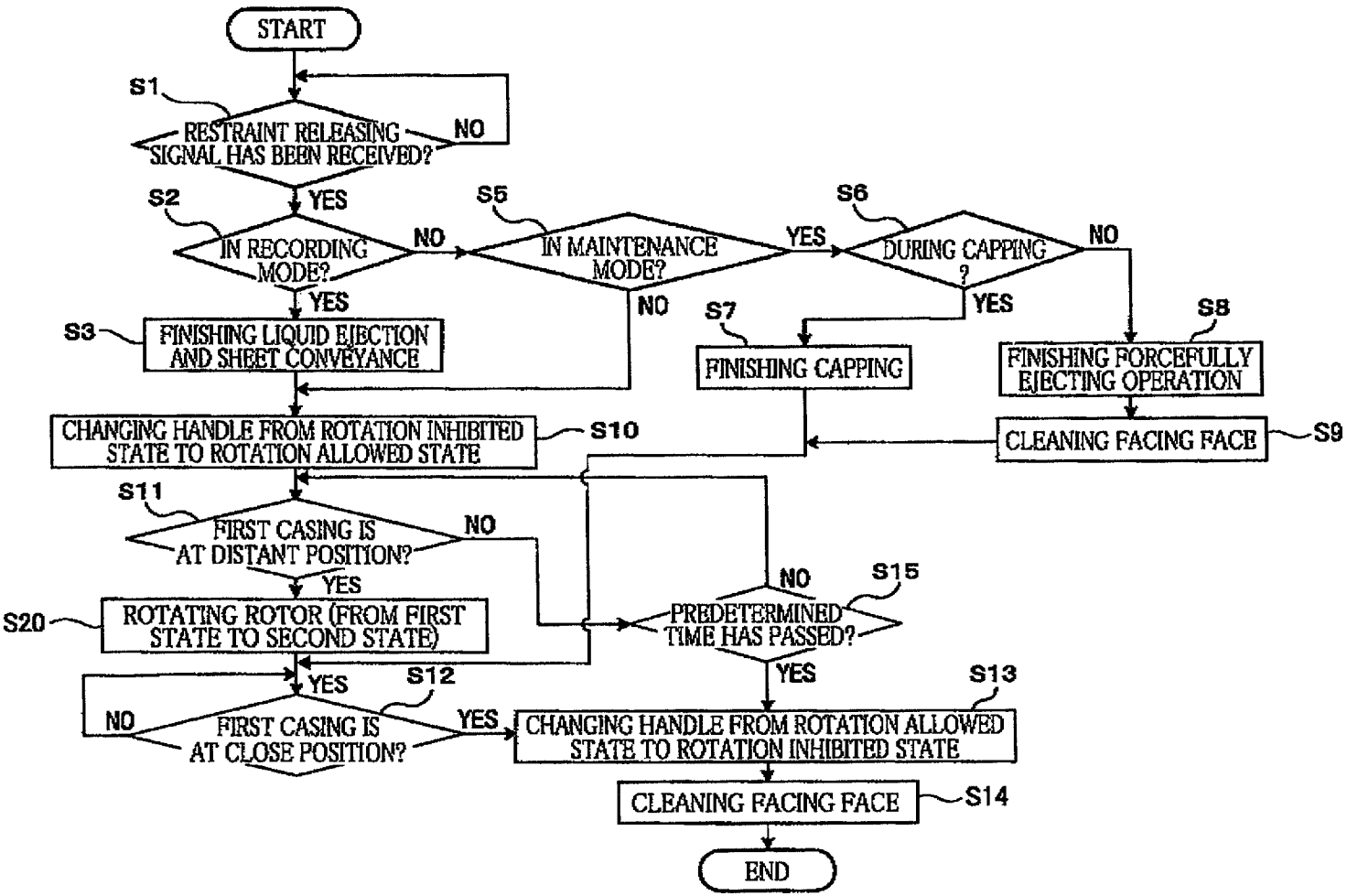
FIG. 9 is a flow-chart showing a control executed by a controller of an ink-jet printer as a second embodiment of the present invention.

There will be next explained an ink-jet printer as a second embodiment of the present invention with reference to FIG. 9. The printer 1 as the present embodiment has the same construction as the printer 1 as the first embodiment, but controls of the controller 1*p* in the second embodiment are partly different from those of the controller 1*p* in the first embodiment. Thus, an explanation of the same controls as those in the first embodiment is omitted, and the controls different from those in the first embodiment will be explained in detail.

As shown in FIG. 9, where the controller 1*p* has received the restraint releasing signal (S1: YES), and the printer 1 is in the recording mode (S2: YES), the controller 1*p* finishes the liquid ejection and the sheet conveyance in S3. After the processing in S3, the controller 1*p* in S10 drives the solenoid 71*b* to change the handle 72 from the rotation inhibited state to the rotation allowed state and then in S11 judges whether the first casing 1*a* is positioned at the distant position or not. Where the controller 1*p* has judged that the first casing 1*a* has been moved to the distant position (S11: YES), the rotor controlling section 106 in S20 controls the rotor driving mechanism 110 so as to rotate the rotor 63 such that the support face 1*a* is changed from the first state to the second state. After the processing in S20, the controller 1*p* in S12 judges whether the first casing 1*a* is located at the close position or not. Where the first casing 1*a* has not been moved, and the controller 1*p* has judged that the first casing 1*a* is positioned at the distant position (S12: NO), the controller 1*p* repeats the processing in S12. On the other hand, where the first casing 1*a* has been moved, and the controller 1*p* has judged that the first casing 1*a* is located at the close position (S12: YES), the controller 1*p* goes to S13 in which the controller 1*p* changes the handle 72 from the rotation allowed state to the rotation inhibited state.

As thus explained, in the printer 1 as the present embodiment, when the first casing 1*a* is located at the distant position, the controller 1*p* rotates the rotor 63 such that the support face 1*a* is changed to the second state, whereby the facing face 62*a* is moved upward, and the support face 61*a* is moved downward. As a result, the support face 61*a* is not exposed to the space formed between the first casing 1*a* and the second casing 1*b*, making it possible to prevent the foreign matters from being landed on the support face 61*a*.

It is noted that the printer 1 as the present second embodiment explained above includes the lock mechanism 70, but this lock mechanism 70 may be omitted. That is, where the lock mechanism 70 is omitted from the printer 1, the processings in S1, S10, and S13 in the flow-chart in FIG. 7 become unnecessary, making it possible to configure the printer 1 such that the rotor 63 is rotated such that the support face 1*a* is changed from the first state to the second state when the first casing 1*a* has been moved to the distant position (this movement is detected in S11). Where the lock mechanism 70 and the processings in S1, S10, and S13 are omitted from the printer 1, the construction of the printer 1 can be simplified.

Figure 10:
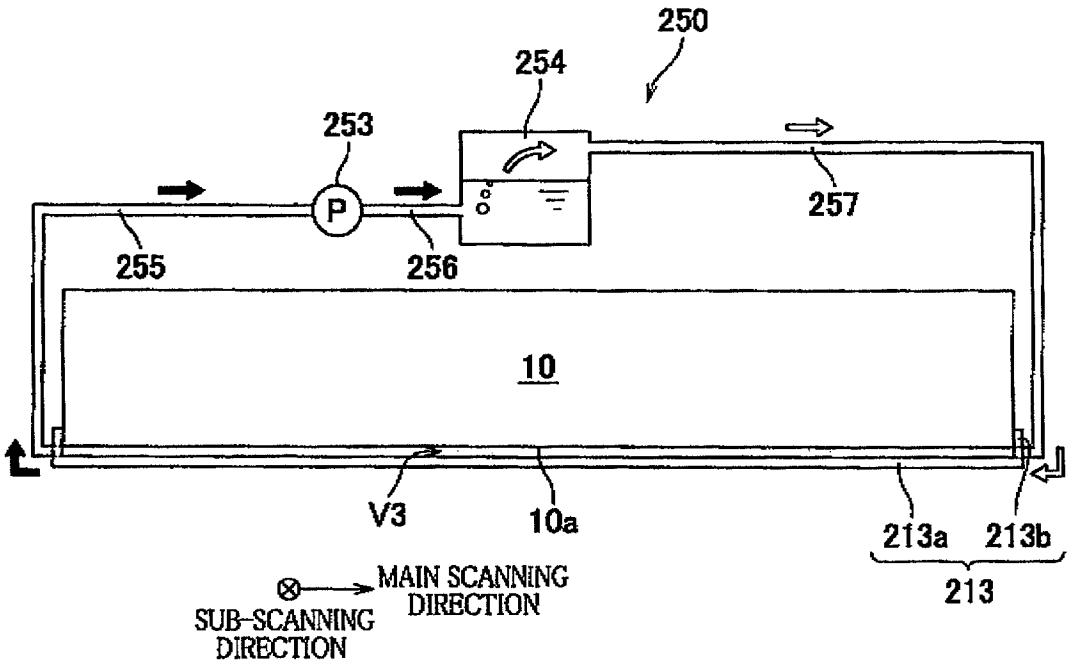
FIG. 10 is a schematic view showing a head, a cover, and a humidifying mechanism of an ink-jet printer as a third embodiment of the present invention.

There will be next explained an ink jet printer as a third embodiment of the present invention with reference to FIG. 10. The printer 1 as the present embodiment is a printer in which covers 213 and a humidifying mechanism (portion) 250 are added to the printer 1 as the first embodiment (noted that the annular member 13 may be omitted). In the following explanation, an explanation of the same construction as that of the printer 1 as the first embodiment is omitted.

The covers 213 are provided on the first casing 1*a* for the respective heads 10. Each of the covers 213 is a plate-like member one size larger than the corresponding ejection face 10*a* in plan view and includes (a) a plate-like main body 213*a* facing to the ejection face 10*a* and (b) an extending portion 213*b* extending from an outer edge of the main body 213*a* in a direction perpendicular to the ejection face 10*a*. Although a drawing and an explanation of a moving mechanism for moving the covers 213 are omitted, the covers 213 are interlocked with the first casing 1*a* and movable between (i) a protecting position (shown in FIG. 10) at which each cover 213 covers the corresponding ejection face 10*a* when the first casing 1*a* is located at the distant position and (ii) a retracted position at which each cover 213 does not cover the corresponding ejection face 10*a* when the first casing 1*a* is located at the close position. Specifically, when the open-close sensor 100 is detecting that the first casing 1*a* is located at the close position, the controller 1*p* controls the cover moving mechanism such that the covers 213 are positioned at the retracted position. When the open-close sensor 100 is detecting that the first casing 1*a* is located at the distant position, the controller 1*p* controls the cover moving mechanism such that the covers 213 are positioned at the protecting position.

The humidifying mechanism 250 is configured to supply humidified air into protecting spaces V3 respectively formed between the ejection faces 10*a* and the covers 213 when the covers 213 are located at the protecting position. The humidifying mechanism 250 is provided on the first casing 1*a* and includes tubes 255, 256, 257, a pump 253, and a tank 254. Among these components, the tubes 255, 256, 257 are provided for each of the heads 10, but the pump 253 and the tank 254 are provided commonly for the two heads 10 (that is, one pump 253 and one tank 254 are provided for the two head 10). It is noted that the following explanation is given for one head 10 for the sake of simplicity.

The tube 255 communicates at its one end with an inner space of the cover 213 and is connected at the other end thereof to the pump 253. The tube 256 connects the pump 253 and the tank 254 such that the pump 253 and the tank 254 can communicate with each other. The tube 257 is connected at one end thereof to the tank 254 and communicates at the other end thereof with the inner space of the cover 213. The one end of the tube 255 and the other end of the tube 257 are respectively connected to one end and the other end of the cover 213 in the main scanning direction.

The tank 254 stores water in its lower space and stores in its upper space the humid air humidified by the water stored in the lower space. The tube 256 communicates with the lower space of the tank 254, and the tube 257 communicates with the upper space of the tank 254. It is noted that a check valve, not shown, is mounted on the tube 256 in order to prevent the water in the tank 254 from flowing into the pump 253, and thus the air flows only in a direction indicated by arrows in FIG. 10.

In the present embodiment, when the controller 1*p* has received the restraint releasing signal, the controller 1*p* controls the humidifying mechanism 250 to supply the humidified air into the protecting space V3. Specifically, the controller 1*p* drives the pump 253 to collect the air in the protecting space V3 from the one end of the tube 255. The collected air passes through the tube 255, the pump 253, and the tube 256 to reach the lower space of the tank 254, and is humidified by the water in the tank 254. The humidified air then flows from the upper space of the tank 254 through the tube 257 to the protecting space V3. In FIG. 10, black arrows indicate a flow of the air before the humidification, and white arrows indicate a flow of the air after the humidification.

As thus explained, in the printer as the present embodiment, while the first casing 1*a* is positioned at the distant position, the ejection face 10*a* is covered with the cover 213, and the humidified air is supplied into the protecting space V3 formed between the ejection face 10*a* and the cover 213. As a result, it is possible to effectively prevent or resolve the drying at the peripheries of the ejection openings. If the peripheries of the ejection openings are dried, the liquid in and near the ejection openings may be solidified or thickened (a viscosity of the liquid may increase), leading to an ejection failure. However, in the present embodiment, it is possible to avoid this situation effectively. Further, even if the liquid has already been thickened or solidified in and near the ejection openings, the moisture is supplied by the humid air, making it possible to resolve the solidification or the increase in the viscosity of the liquid.

While the embodiments of the present invention have been described above, it is to be understood that the invention is not limited to the details of the illustrated embodiments, but may be embodied with various changes and modifications, which may occur to those skilled in the art, without departing from the spirit and scope of the invention.

For example, after the first casing has been moved from the distant position to the close position or where the controller 1*p* has received the restraint releasing signal during the forcefully ejecting operation, the controller 1*p* may not control the maintenance portion to clean the facing face by the cleaning member. The controller 1*p* is not limited to control the moving device such that the moving device is in the first state in the case of the recording mode and such that the moving device is in the second state in the case of the maintenance mode. For example, the first state may be established in the maintenance mode. Where the controller 1*p* has detected the occurrence of the jamming in the recording mode, the controller 1*p* may not execute the same processings as in the case where the controller 1*p* has received the restraint releasing signal. In the forcefully ejecting operation performed in the maintenance mode, the liquid may be ejected onto a face other than the facing face.

The constructions of the annular member 13 and the covers 213 may be modified as needed. Further, these components may be omitted.

In the above-described embodiments, the conveyance roller pairs 22-28 are used as one example of a conveyance portion, but the conveyance portion may be constituted by a conveyance belt, belt rollers, and other components. In this case, the conveyance belt functions as the support portion, and a face of the conveyance belt functions as the support face.

In the above-described embodiments, the facing member 62 of the maintenance portion is formed integrally with the support portion (i.e., the platen 61), but the facing member 62 is not limited to be integral with the support portion. For example, the printer 1 may be configured such that the rotor 63 in the first embodiment is omitted, and the facing member 62 is located so as to be distant from the support portion, and the facing member and the support portion are moved independently of each other.

In the above-described embodiments, the wiper is used as the cleaning member, but another cleaning member such as a brush and a sponge may be used as long as the facing face is cleaned. Further, the cleaning member may be omitted.

The position of the maintenance portion is not limited, and the maintenance position may be positioned on a side portion of the head instead of just under the head.

The first casing is not limited to be pivoted with respect to the second casing about the hinge portion. For example, the first casing may be moved in the vertical direction or in the horizontal direction.

The construction of the restraining portion may be modified as needed. For example, in the above-described embodiment, the rotation of the handle 72 is inhibited by the solenoid and changed from the rotation inhibited state to the rotation allowed state by the control of the controller 1*p*, but the printer 1 may be configured such that the handle 72 is always in the rotation allowed state by omitting the solenoid, and when the user has rotated the handle 72, the restraint releasing signal is transmitted to the controller 1*p* from a sensor for sensing the rotation of the handle 72. Alternatively, instead of the manual operation of the user, the controller 1*p* may control the rotation of the handle 72 by controlling a mechanism for rotating the handle 72. Further, the handle 72 operable by the user may be omitted. In this case, the restraining portion is changed between the restrained state and the unrestrained state by the control of the controller 1*p*.

Likewise, instead of the manual operation of the user, the controller 1*p* may control the movement of the first casing by controlling a mechanism for moving the first casing.

The present invention is applicable to not only the monochrome printer but also a color printer. Further, the present invention is applicable to any of a line printer and a serial printer. Further, the present invention is applicable to not only the printer but also another liquid ejection apparatus such as a facsimile machine and a copying machine. The liquid ejection head may eject any liquid other than the ink and the pretreatment liquid. Further, the number of the liquid ejection heads in the liquid ejection apparatus may be any number as long as the number is equal to or greater than one. The recording medium is not limited to the sheet P, and any recordable medium may be used.

What is claimed is:

1. A liquid ejection apparatus comprising:

a first casing;

a second casing;

a restraining portion; and a controller, wherein the first casing is movable relative to the second casing between (i) a close position at which the first casing is close to the second casing and (ii) a distant position farther from the second casing than the close position, the first casing accommodating a liquid ejection head comprising an ejection face having a plurality of ejection openings through which liquid is ejected onto a recording medium, wherein the second casing accommodates:

a support portion comprising a support face for supporting the recording medium while facing the ejection face; and a moving device configured to move the support portion such that the support face selectively takes (i) a first state in which the support face faces the ejection face and (ii) a second state in which the support face does not face the ejection face, wherein the restraining portion is configured to restrain the movement of the first casing located at the close position, and wherein the controller is configured to control the moving device such that the support face takes the second state when the controller has received a restraint releasing signal that indicates that the restraint of the restraining portion is released.

2. The liquid ejection apparatus according to claim 1, wherein the second casing farther accommodates a maintenance portion having a facing face that takes a posture in which the facing face faces the ejection face, and wherein the moving device is configured to move the support portion and the maintenance portion such that the support face faces the ejection face, and the facing face does not face the ejection face in the first state and such that the support face does not face the ejection face, and the facing face faces the ejection face in the second state.

3. The liquid ejection apparatus according to claim 2, wherein the controller is configured to control the moving device such that the support face takes the first state in a recording mode in which the liquid is ejected from the ejection openings onto the recording medium and such that the support face takes the second state in a maintenance mode in which a maintenance is performed for the ejection face.

4. The liquid ejection apparatus according to claim 2, wherein the maintenance portion comprises a cleaning member for cleaning the facing face, and wherein the controller is configured to control the maintenance portion such that the cleaning member cleans the facing face after the first casing has been moved from the distant position to the close position.

5. The liquid ejection apparatus according to claim 2, wherein the controller is configured to control the liquid ejection head and the moving device in a maintenance mode in which a maintenance is performed for the ejection face, such that a forcefully ejecting operation for ejecting the liquid from the ejection openings onto the facing face is performed.

6. The liquid ejection apparatus according to claim 5, wherein, the controller controls the liquid ejection head to finish the forcefully ejecting operation when the controller has received the restraint releasing signal while controlling the liquid ejection head to perform the forcefully ejecting operation.

7. The liquid ejection apparatus according to claim 6, wherein the maintenance portion comprises a cleaning member for cleaning the facing face, and wherein the controller controls the maintenance portion such that the cleaning member cleans the facing face after the controller controls the liquid ejection head to finish the forcefully ejecting operation.

8. The liquid ejection apparatus according to claim 2, further comprising an annular member provided on the liquid ejection head so as to enclose the ejection face, wherein the annular member is positioned at a position at which a distal end of the annular member is held in contact with the facing face such that an ejection space formed between the ejection face and the facing face is isolated from an outside space.

9. The liquid ejection apparatus according to claim 1, further comprising a conveyance portion configured to convey the recording medium onto the support face facing the ejection face, wherein the controller is configured to control the liquid ejection head and the conveyance portion such that the ejection of the liquid from the ejection openings and the conveyance of the recording medium are finished when the controller has received the restraint releasing signal in a recording mode in which the liquid is ejected from the ejection openings onto the recording medium.

10. The liquid ejection apparatus according to claim 1, further comprising a jamming detection section configured to detect an occurrence of a jamming of the recording medium, wherein the controller is configured to control the moving device such that the support face takes the second state when the jamming detection section has detected the occurrence of the jamming.

11. The liquid ejection apparatus according to claim 1, further comprising:

a cover provided on the first casing and movable between (i) a protecting position at which the cover covers the ejection face when the first casing is located at the distant position and (ii) a retracted position at which the cover does not cover the ejection face when the first casing is located at the close position; and a humidifying portion configured to supply a humidified air into a protecting space formed between the ejection face and the cover when the cover is located at the protecting position, wherein the controller is configured to control the humidifying portion to supply the humidified air into the protecting space when the controller has received the restraint releasing signal.

12. The liquid ejection apparatus according to claim 1, wherein the controller controls the restraining portion to release the restraint of the movement of the first casing located at the close position.

13. A liquid ejection apparatus comprising:

a first casing;

a second casing; and a controller, wherein the first casing is movable relative to the second casing between (i) a close position at winch the first casing is close to the second casing and (ii) a distant position farther from the second casing than the close position, the first casing accommodating a liquid ejection bead comprising an ejection face having a plurality of ejection openings through which liquid is ejected onto a recording medium, wherein the second casing accommodates:

a support portion comprising a support face for supporting the recording medium while facing the ejection face; and a moving device configured to move the support portion such that the support face selectively takes (i) a first state in which the support face faces the ejection face and (ii) a second state in which the support face does not face the ejection face, wherein the liquid ejection apparatus further comprises a jamming detection section configured to detect an occurrence of a jamming of the recording medium, and wherein the controller is configured to control the moving device such that the support face takes the second state when the jamming detection section has detected the occurrence of the jamming.

14. A liquid ejection apparatus comprising:

a first casing;

a second casing; and a controller, wherein the first casing is movable relative to the second casing between (i) a close position at which the first casing is close to the second casing and (ii) a distant position farther from the second casing than the close position, the first casing accommodating a liquid ejection head comprising an ejection face having a plurality of ejection openings through which liquid is ejected onto a recording medium, wherein the second casing accommodates:

a support portion comprising a support face for supporting the recording medium while facing the ejection face; and a moving device configured to move the support portion such that the support face selectively takes (i) a first state in which the support face faces the ejection face and (ii) a second state in which the support face does not face the ejection face, wherein the liquid ejection apparatus further comprises a first-casing-position detecting section configured to detect whether the first casing is located at the close position or the distant position, and wherein the controller is configured to control the moving device such that the support face takes the second state when the first-casing-position detecting section detects that the first casing is located at the distant position.

* * * * *